US008280729B2

(12) United States Patent
Yu et al.

(10) Patent No.: US 8,280,729 B2
(45) Date of Patent: Oct. 2, 2012

(54) SYSTEM AND METHOD FOR ENCODING AND DECODING PULSE INDICES

(75) Inventors: Xiang Yu, Waterloo (CA); Dake He, Waterloo (CA); En-hui Yang, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 287 days.

(21) Appl. No.: 12/692,245

(22) Filed: Jan. 22, 2010

(65) Prior Publication Data

US 2011/0184733 A1 Jul. 28, 2011

(51) Int. Cl.
*G10L 19/10* (2006.01)
*G10L 19/12* (2006.01)

(52) U.S. Cl. ..... 704/219; 704/200; 704/211; 704/223; 708/490; 375/240.03; 341/51

(58) Field of Classification Search ..... 704/219
See application file for complete search history.

(56) References Cited

U.S. PATENT DOCUMENTS

| | | | | |
|---|---|---|---|---|
| 3,872,503 | A * | 3/1975 | Shutterly | 360/8 |
| 4,122,440 | A * | 10/1978 | Langdon et al. | 341/51 |
| 4,905,297 | A * | 2/1990 | Langdon et al. | 382/247 |
| 5,060,268 | A * | 10/1991 | Asakawa et al. | 704/211 |
| 5,546,080 | A * | 8/1996 | Langdon et al. | 341/107 |
| 5,754,976 | A | 5/1998 | Adoul et al. | |
| 5,774,081 | A * | 6/1998 | Cheng et al. | 341/107 |
| 6,141,638 | A * | 10/2000 | Peng et al. | 704/211 |
| 6,236,960 | B1 * | 5/2001 | Peng et al. | 704/211 |
| 6,662,154 | B2 * | 12/2003 | Mittal et al. | 704/219 |
| 7,280,959 | B2 * | 10/2007 | Bessette | 704/219 |
| 7,983,902 | B2 * | 7/2011 | Wu et al. | 704/10 |
| 8,000,967 | B2 * | 8/2011 | Taleb | 704/264 |
| 8,005,141 | B2 * | 8/2011 | He et al. | 375/240.03 |
| 2004/0015349 | A1 * | 1/2004 | Vinton et al. | 704/230 |
| 2005/0065785 | A1 * | 3/2005 | Bessette | 704/211 |
| 2005/0065788 | A1 * | 3/2005 | Stachurski | 704/229 |
| 2006/0290539 | A1 * | 12/2006 | Tomic | 341/50 |
| 2008/0120098 | A1 * | 5/2008 | Makinen et al. | 704/222 |
| 2009/0024398 | A1 * | 1/2009 | Mittal et al. | 704/500 |
| 2009/0030912 | A1 * | 1/2009 | Parida | 707/100 |
| 2009/0048852 | A1 * | 2/2009 | Burns et al. | 704/503 |
| 2009/0097587 | A1 * | 4/2009 | Ma | 375/286 |
| 2009/0097595 | A1 * | 4/2009 | Ma | 375/340 |
| 2009/0100121 | A1 * | 4/2009 | Mittal et al. | 708/495 |
| 2009/0112607 | A1 | 4/2009 | Ashley et al. | |
| 2009/0222711 | A1 * | 9/2009 | Belogolovy | 714/780 |
| 2010/0088090 | A1 * | 4/2010 | Ramabadran | 704/219 |
| 2010/0235709 | A1 * | 9/2010 | Kowalski et al. | 714/752 |
| 2011/0046923 | A1 * | 2/2011 | Lee et al. | 703/1 |

(Continued)

OTHER PUBLICATIONS

Langdon Jr., "Adaptive Binary Arithmetic Coding for Multi-Media Applications", IEEE Compcon Digest of Papers, 1991, pp. 354-357.

(Continued)

*Primary Examiner* — Talivaldis Ivars Smits
*Assistant Examiner* — Fariba Sirjani

(57) ABSTRACT

Methods, and corresponding codec-containing devices are provided that have source coding schemes for encoding a component of an excitation. In some cases, the source coding scheme is an enumerative source coding scheme, while in other cases the source coding scheme is an arithmetic source coding scheme. In some cases, the source coding schemes are applied to encode a fixed codebook component of the excitation for a codec employing codebook excited linear prediction, for example an AMR-WB (Adaptive Multi-Rate-Wideband) speech codec.

12 Claims, 10 Drawing Sheets

U.S. PATENT DOCUMENTS

| | | | | |
|---|---|---|---|---|
| 2011/0096830 | A1* | 4/2011 | Ashley et al. | 375/240.03 |
| 2011/0156932 | A1* | 6/2011 | Mittal et al. | 341/51 |
| 2011/0173007 | A1* | 7/2011 | Multrus et al. | 704/500 |
| 2011/0238426 | A1* | 9/2011 | Fuchs et al. | 704/500 |

OTHER PUBLICATIONS

Mittal et al., "Low Complexity Factorial Pulse Coding of MDCT Coefficients using Approximation of Combinatorial Functions", IEEE International Conference on Speech, Acoustics and Signal Processing, ICASSP 2007, vol. 1, pp. I-289-I-292.

Ashley et al., "Wideband Coding of Speech Using a Scalable Pulse Codebook", Proceedings of the IEEE Workshop on Speech Coding, 2000, pp. 148-150.

Mittal et al., "Coding Unconstrained FCB Excitation using Combinatorial and Huffman Codes", Proceedings of the IEEE Workshop on Speech Coding, 2002, pp. 129-131.

Jones, "An Efficient Coding System for Long Source Sequences", IEEE Transactions on Information Theory, vol. IT-27, No. 3, May 1981, pp. 280-291.

International Search Report based on International Application No. PCT/CA2011/050036 dated Mar. 14, 2011.

Amir Said, Introduction to Arithmetic Coding Theory and Practice, Hewlett-Packard Laboratories Report, HPL-2004-76, Apr. 21, 2004.

Thomas M. Cover, Enumerative Source Encoding, IEEE Transactions on Information Theory, vol. IT-19, No. 1, Jan. 1973.

Digital cellular telecommunications system (Phase 2+); Universal Mobile Telecommunications System (UMTS); LTE; Speech codec speech processing functions; Adaptive Multi-Rate—Wideband (AMR-WB) speech codec; Transcoding functions (3GPP TS 26.190 version 8.0.0 Release 8), ETSI TS 126 190 V8.0.0 (Jan. 2009).

* cited by examiner

SYSTEM AND METHOD FOR ENCODING AND DECODING PULSE INDICES

FIELD

The application relates to encoding and decoding pulse indices, such as algebraic codebook indices, and to related systems, devices, and methods.

BACKGROUND

AMR-WB (Adaptive Multi-Rate-Wideband) is a speech codec with a sampling rate of 16 kHz that is described in ETSI TS 126 190 V.8.0.0 (2009-01) hereby incorporated by reference in its entirety. AMR-WB has nine speech coding rates. In kilobits per second, they are 23.85, 23.05, 19.85, 18.25, 15.85, 14.25, 12.65, 8.85, and 6.60. The bands 50 Hz-6.4 kHz and 6.4 kHz-7 kHz are coded separately. The 50 Hz-6.4 kHz band is encoded using ACELP (Algebraic Codebook Excited Linear Prediction), which is the technology used in the AMR, EFR, and G.729 speech codecs among others.

CELP (Codebook Excited Linear Prediction) codecs model speech as the output of an excitation input to a digital filter, where the digital filter is representative of the human vocal tract and the excitation is representative of the vibration of vocal chords for voiced sounds or air being forced through the vocal tract for unvoiced sounds. The speech is encoded as the parameters of the filter and the excitation.

The filter parameters are computed on a frame basis and interpolated on a subframe basis. The excitation is usually computed on a subframe basis and consists of an adaptive codebook excitation added to a fixed codebook excitation. The purpose of the adaptive codebook is to efficiently code the redundancy due to the pitch in the case of voiced sounds. The purpose of the fixed codebook is to code what is left in the excitation after the pitch redundancy is removed.

AMR-WB operates on frames of 20 msec. The input to AMR-WB is downsampled to 12.8 kHz to encode the band 50 Hz-6.4 kHz. There are four subframes of 5 msecs each. At a 12.8 kHz sampling rate, this means that the subframe size is 64 samples. The four subframes are used to choose the linear prediction filter and identify the excitement using known techniques. To produce 64 samples at the output of the linear prediction filter thus determined, an excitation with 64 pulse positions is needed.

With ACELP, the fixed codebook component of the excitation is implemented using an "algebraic codebook" approach. An algebraic codebook approach involves choosing the locations for signed pulses of equal amplitude as the subframe excitation.

In the case of AMR-WB, the 64 position component of the excitation is divided into 4 interleaved tracks of 16 positions each. Each of the 16 positions can have a signed pulse or not. Encoding all 16 bit positions for each track as a signed pulse or not will result in the least amount of distortion. However, for bandwidth efficiency purposes, rather than encoding all 16 pulse positions, only the positions of some maximum number of pulses are encoded. The higher the maximum number, the lower the distortion. With AMR-WB, the number of positions that are encoded varies with bit rate.

The 23.05 kbps and 23.85 kbps modes both use 6 pulses per track. The AMR-WB speech codec defined in ETSI TS 126 190 V.8.0.0 (2009-01) encodes the algebraic codebook index for one subframe with 88 bits. The pulses are encoded with 22 bits per track.

The 19.85 kbps mode uses 5 pulses in 2 of the 4 tracks and 4 pulses in the other 2. The AMR-WB speech codec defined in ETSI TS 126 190 V.8.0.0 (2009-01) encodes the algebraic codebook index for one subframe with 72 bits.

The 18.25 kbps mode uses 4 pulses in each of the 4 tracks. The AMR-WB speech codec defined in ETSI TS 126 190 V.8.0.0 (2009-01) encodes the algebraic codebook index for one subframe with 64 bits.

DETAILED DESCRIPTION

The encoding of the excitation is sometimes referred to as source coding. Methods, systems, devices and computer readable media for source coding of the algebraic codebook indices are provided.

It should be understood at the outset that although illustrative implementations of one or more embodiments of the present disclosure are provided below, the disclosed systems and/or methods may be implemented using any number of techniques, whether or not currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
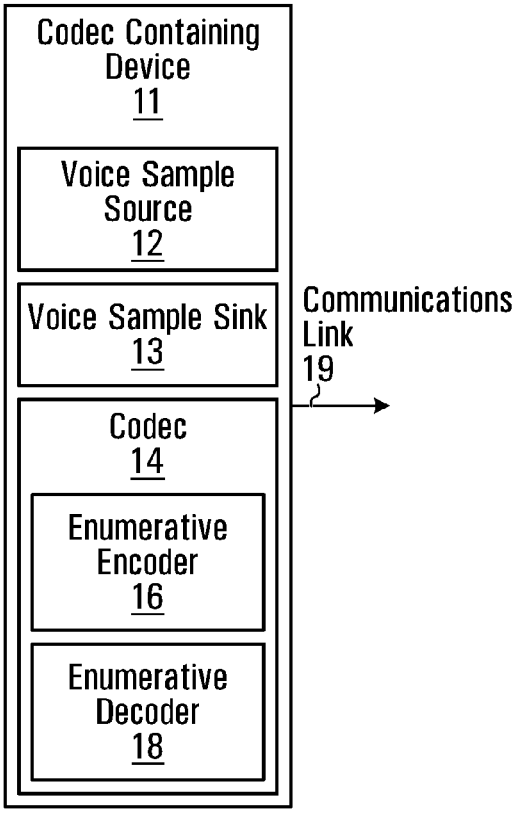
FIG. 1 is a block diagram of a first CODEC containing device.

FIG. 1 is a block diagram of a first codec containing device generally indicated at 11. The first codec containing device 11 may be any device that is configured with a codec. Specific examples include a digital telephone such as a mobile telephone, and a camcorder. The codec containing device 11 of FIG. 1 contains a voice sample source 12, a voice sample sink 13 and a codec 14. The voice sample source 12 provides voice samples. This may involve reading voice samples stored in memory, or may involve a microphone and ADC (analog to digital converter) for directly generating voice samples, to name two specific examples. The voice sample sink 13 may be a memory for storing voice samples, or may involve a DAC (digital to analog converter) and speaker for generating audible voice from received samples. The codec containing device 11 is connectable to one or more communications links 19 over which a signal containing an encoding output of the codec 14 may be transmitted, and/or a signal containing a decoding input of the codec 14 may be received. The communications links 19 may be any communications links supporting digital communications; examples include wired, optical, and wireless links.

Codec 14 contains an enumerative encoder 16 and/or an enumerative decoder 18; the enumerative encoder 16, when present, is in accordance with one of the enumerative encoder embodiments described below, and the enumerative decoder 18, when present, is in accordance with one of the enumerative decoder embodiments described below. The codec 14 operates to perform an enumerative encoding operating on samples received from the voice sample source 12 and/or to perform an enumerative decoding operation to produce samples for the voice sample sink 13. The codec 14 may be implemented entirely in hardware, or in hardware (such as a microprocessor or DSP to name a few specific examples) in combination with firmware and/or software. Another embodiment provides a computer readable medium having computer executable code stored thereon which, when executed by a codec-containing device, such as a mobile station or server, controls the codec-containing device to perform the enumerative encoding and/or enumerative decoding functionality.

Figure 2:
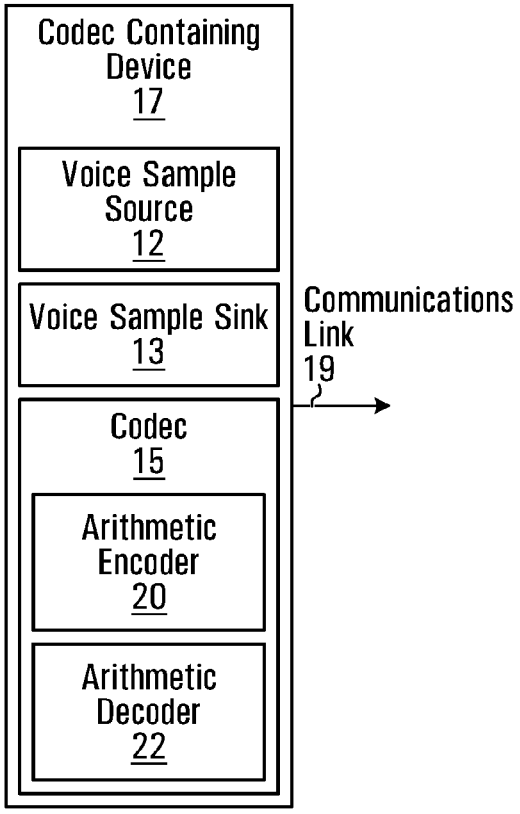
FIG. 2 is a block diagram of a second CODEC containing device.

Referring now to FIG. 2, shown is a block diagram of a second codec containing device generally indicated at 17. The description of FIG. 1 applies to FIG. 2 except for the fact that codec 14 of FIG. 1 is replaced with codec 15 in FIG. 2. Codec 15 contains an arithmetic encoder 20 and/or an arithmetic decoder 22; the arithmetic encoder 20, when present, is in accordance with one of the arithmetic encoder embodiments described below, and the arithmetic decoder 22, when present, is in accordance with one of the arithmetic decoder embodiments described below. The codec 15 operates to perform an arithmetic encoding operating on samples received from the voice sample source 12 and/or to perform an arithmetic decoding operation to produce samples for the voice sample sink 13. The codec 15 may be implemented entirely in hardware, or in hardware (such as a microprocessor or DSP to name a few specific examples) in combination with firmware and/or software. Another embodiment provides a computer readable medium having computer executable code stored thereon which, when executed by a codec-containing device, such as a mobile station or server, controls the codec-containing device to perform the arithmetic encoding and/or arithmetic decoding functionality.

Figure 3:
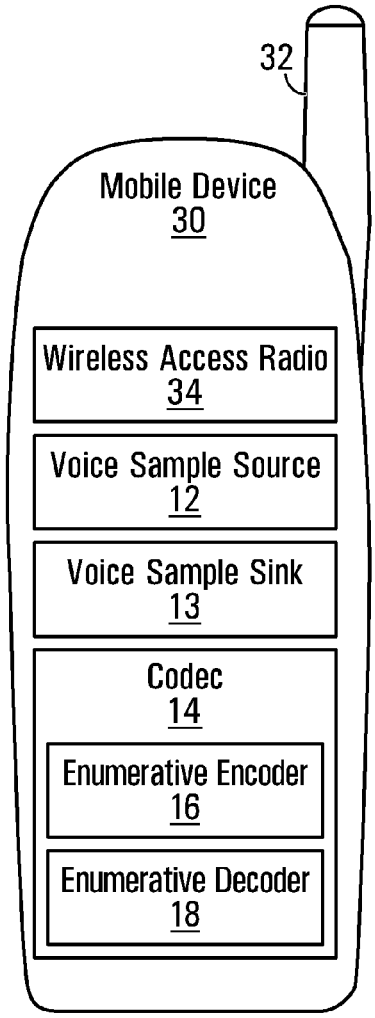
FIG. 3 is a block diagram of a first mobile device.

Referring now to FIG. 3, shown is a block diagram of a mobile device generally indicated at 30. The mobile device 30 is a specific example of a codec containing device 11 of FIG. 1. The mobile device 30 has at least one antenna 32 and at least one wireless access radio 34. The voice sample source 12, voice sample sink 13 and codec 14 are as described above with reference to FIG. 1. Of course, the mobile device 30 may have other components, not shown, for implementing the normal functionality of a mobile device.

Figure 4:
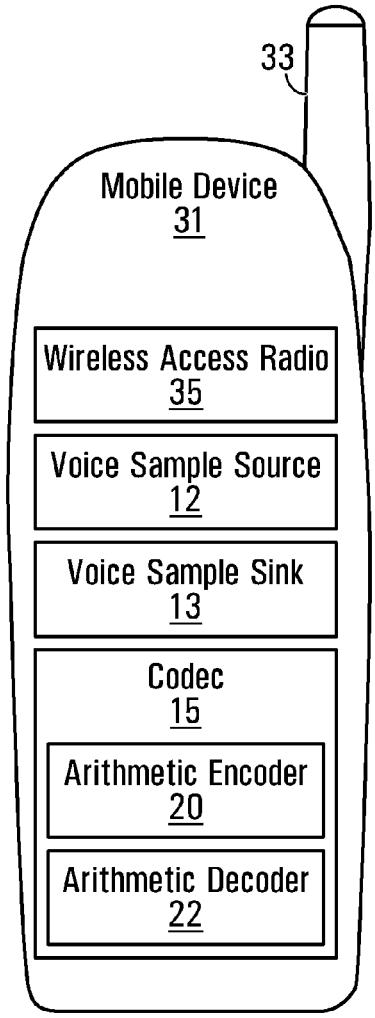
FIG. 4 is a block diagram of a second mobile device.

Referring now to FIG. 4, shown is a block diagram of a mobile device generally indicated at 31. The mobile device 31 is a specific example of a codec containing device 17 of FIG. 2. The mobile device 31 has at least one antenna 33 and at least one wireless access radio 35. The voice sample source 12, voice sample sink 13 and codec 15 are as described above with reference to FIG. 2. Of course, the mobile device 31 may have other components, not shown, for implementing the normal functionality of a mobile device.

Figure 5:
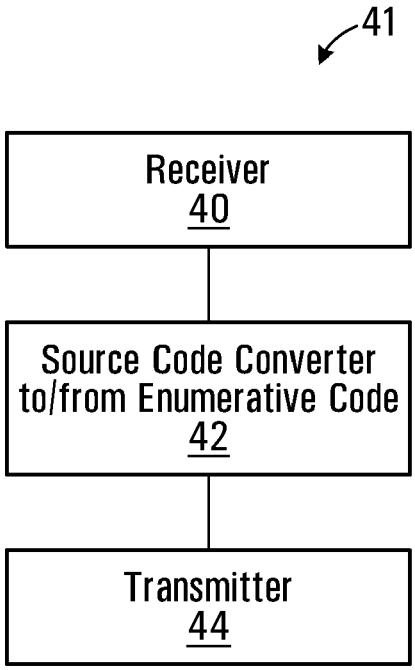
FIG. 5 is a block diagram of an apparatus in which a conversion between a first source coding scheme and a second source coding scheme is performed, one of the source coding schemes being an enumerative source coding.

FIG. 5 is a block diagram of an apparatus generally indicated at 41. The apparatus of FIG. 5 may for example form part of a telephone switch. The apparatus has a receiver 40, a source code converter to/from enumerative code 42, and a transmitter 44. The receiver 40 is for receiving encoded voice. This may involve receiving a wireline, wireless, or optical signal, to name a few specific examples. The transmitter 44 is for transmitting encoded voice. This may involve transmitting wireline, wireless or optical signals, to name a few specific examples. The source code converter to/from enumerative code 42 performs a conversion between a first source coding scheme and a second source coding scheme. In some embodiments, both conversions are performed—namely from the first source coding scheme to the second source coding scheme, and from the second source coding scheme to the first source coding scheme. One of the schemes is an enumerative source coding scheme according to one of the embodiments described below. The other of the schemes is a different source coding scheme. In a specific example, the other of the schemes is one of the source coding schemes defined in ETSI TS 126 190 V.8.0.0 (2009-01).

In a very specific implementation, the received signal contains source coding according to one of the enumerative encoding embodiments described herein, and the transmitted signal contains source coding according to ETSI TS 126 190 V.8.0.0 (2009-01).

In another very specific implementation, the received signal contains source coding according to ETSI TS 126 190 V.8.0.0 (2009-01), and the transmitted signal contains source coding according to one of the enumerative encoding embodiments described herein.

Figure 6:
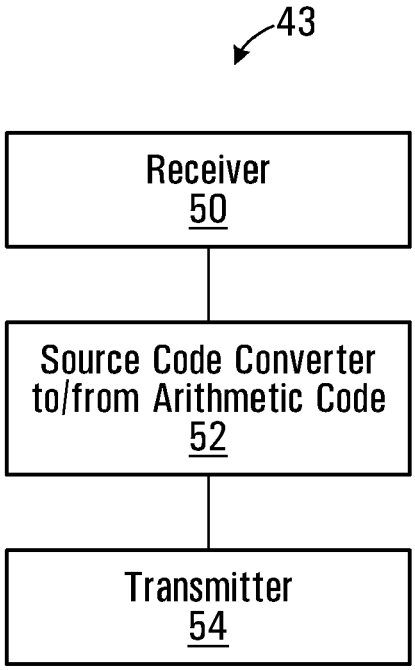
FIG. 6 is a block diagram of an apparatus in which a conversion between a first source coding scheme and a second source coding scheme is performed, one of the source coding schemes being an arithmetic code.

FIG. 6 is a block diagram of an apparatus generally indicated at 43. The apparatus of FIG. 6 may for example form part of a telephone switch. The apparatus has a receiver 50, a source code converter to/from arithmetic code 52, and a transmitter 54. The receiver 50 and transmitter 54 are as described above with reference to FIG. 5. The source code converter to/from arithmetic code 52 performs a conversion between a first source coding scheme and a second source coding scheme. In some embodiments, both conversions are performed—namely from the first source coding scheme to the second source coding scheme, and from the second source coding scheme to the first source coding scheme. One of the schemes is an arithmetic source coding scheme according to one of the embodiments described below. The other of the schemes is a different source coding scheme. In a specific example, the other of the schemes is one of the source coding schemes defined in ETSI TS 126 190 V.8.0.0 (2009-01).

The source coding schemes and corresponding decoding schemes referred to above, detailed below by way of example, allow for the encoding and decoding of a component of an excitation, for example the fixed codebook portion of an excitation for an algebraic code. In some embodiments, another component of the excitation, for example an adaptive codebook component of an algebraic code, may be separately encoded and provided to the decoder. In addition, the filter parameters are provided to the decoder. In the decoder, the components are combined to produce the excitation that is used to drive filter defined by the filter parameters. However, the source coding and decoding schemes may have other uses in codec applications that require an identification of a set of pulse positions.

In a very specific implementation, the received signal contains source coding according to one of the arithmetic encoding embodiments described herein, and the transmitted signal contains source coding according to ETSI TS 126 190 V.8.0.0 (2009-01).

In another very specific implementation, the received signal contains source coding according to ETSI TS 126 190 V.8.0.0 (2009-01), and the transmitted signal contains source coding according to one of the arithmetic encoding embodiments described herein.

First Enumerative Source Coding Example: Encoding Six Pulse Positions to Produce an Index, and Decoding an Index to Produce Six Pulse Positions If there are six pulse positions defined as $0 \leqq i_1 < i_2 < i_3 < i_4 < i_5 < i_6 \leqq 15$, then the six pulses are encoded as the index $$x = \binom{i_6}{6} + \binom{i_5}{5} + \binom{i_4}{4} + \binom{i_3}{3} + \binom{i_2}{2} + \binom{i_1}{1},$$

where $$\binom{n}{k}$$

for n<k is defined to be 0. Typically, x is in a binary form and is accompanied by six sign bits, one for each pulse.

The following method can be performed to decode an index x to determine six pulse positions $0 \leqq i_1 < i_2 < i_3 < i_4 < i_5 < i_6 15$:

1) set x=index to be decoded 2) first find the largest value of n such that $$\binom{n}{6}$$

is still less than x. This is $i_6$.

3) Subtract $$\binom{i_6}{6}$$

from the value of x and store this as x. Now, find the largest value of n such that $$\binom{n}{5}$$

is still less than x. This is $i_5$.

4) Subtract $$\binom{i_5}{5}$$

from the value of x and store this as x. Now, find the largest value of n such that $$\binom{n}{4}$$

is still less than x. This is $i_4$.

5) Subtract $$\binom{i_4}{4}$$

from the value of x and store this as x. Now, find the largest value of n such that $$\binom{n}{3}$$

is still less than x. This is $i_3$.

6) Subtract $$\binom{i_3}{3}$$

from the value of x and store this as x. Now, find the largest value of n such that $$\binom{n}{2}$$

is still less than x. This is $i_5$.

7) Subtract $$\binom{i_2}{2}$$

from the value of x and store this as x. Now, find the largest value of n such that $$\binom{n}{1}$$

is still less than x. This is $i_1$.

Second Enumerative Source Coding Example: Encoding J Pulse Positions to Produce an Index and Decoding an Index to Produce J Pulse Positions More generally, if there are J pulse positions defined as $0 \leqq i_1 \ldots < i_J \leqq m$, then the J pulses can be encoded as the index $$x = \binom{i_J}{J} + \binom{i_{J-1}}{J-1} + \ldots + \binom{i_1}{1}.$$

where $$\binom{n}{k}$$

for n<k is defined to be 0. Typically, x is in a binary form and is accompanied by J sign bits.

For decoding, the following method can be performed to decode an index x to determine J pulse positions $0 \leqq i_1 \ldots < i_J \leqq m$.

1) Set x initially to be the index to be decoded;

2) For j=J, J−1, . . . , 2, 1:

a) find the largest value of n such that $$\binom{n}{j}$$

is still less than x;

b) Set $i_j$=n; and c) Subtract $$\binom{i_j}{j}$$

from the value of x and store this as x. Note the order of steps b) and c) can be reversed.

It can be seen that an increase in the number m (the maximum bit position) will increase the number of bits necessary to encode the index.

Figure 7:
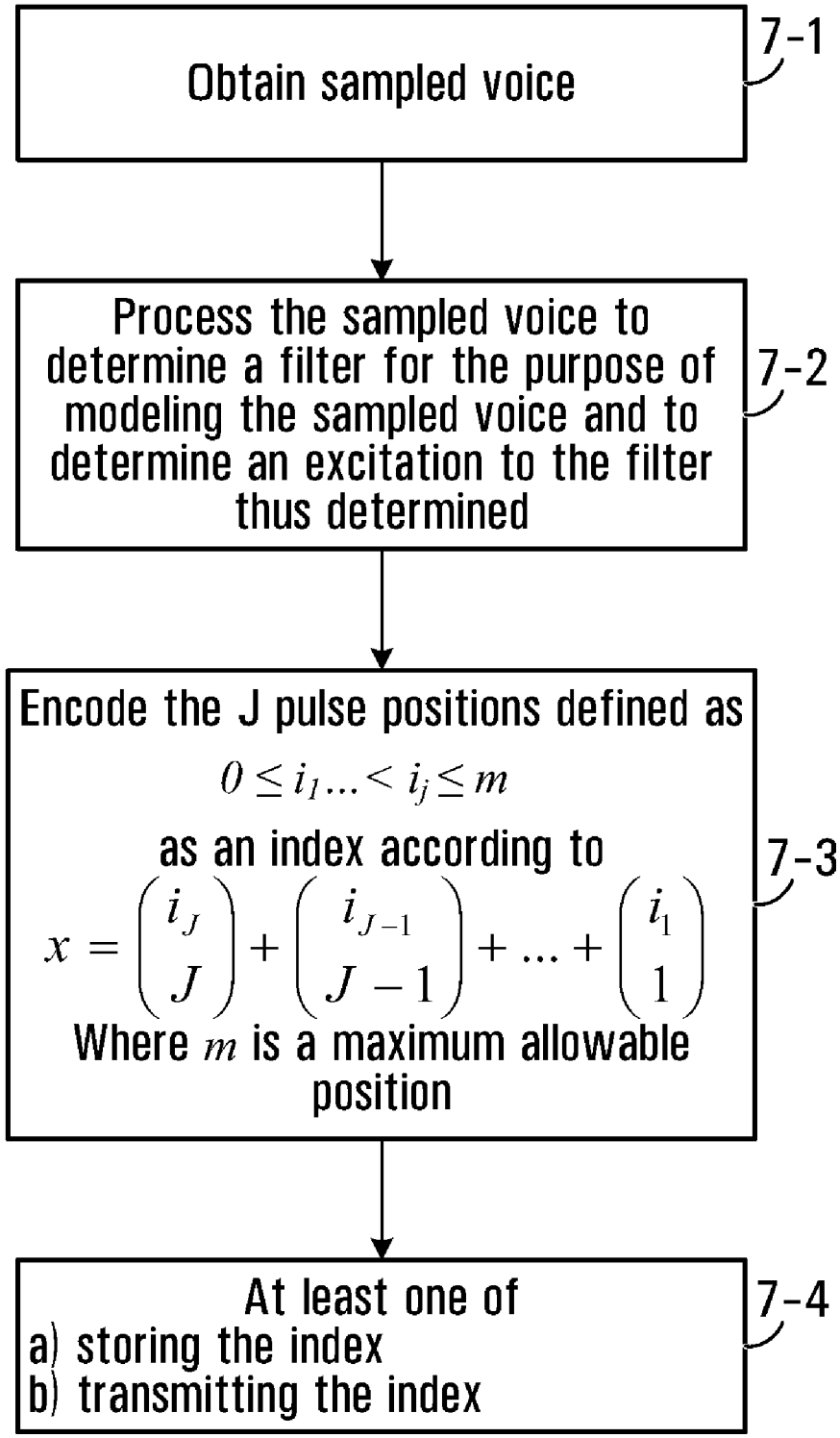
FIG. 7 is a flowchart of a first method of source coding.

Referring now to FIG. 7, shown is a flowchart of one encoding method based on the second example. The method begins at block 7-1 with obtaining sampled voice. In block 7-2, the sampled voice is processed to determine a filter for the purpose of modeling the sampled voice and to determine an excitation to the filter thus determined (7-2), the excitation comprising J pulse positions, where J≧2. Block 7-3 involves encoding the J pulse positions defined as $0 \leqq i_1 \ldots < i_J \leqq m$ as an index according to $$x = \binom{i_J}{J} + \binom{i_{J-1}}{J-1} + \ldots + \binom{i_1}{1}$$

where m is a maximum allowable position. The method continues with block 7-4 which involves at least one of a) storing the index and b) transmitting the index.

Figure 8:
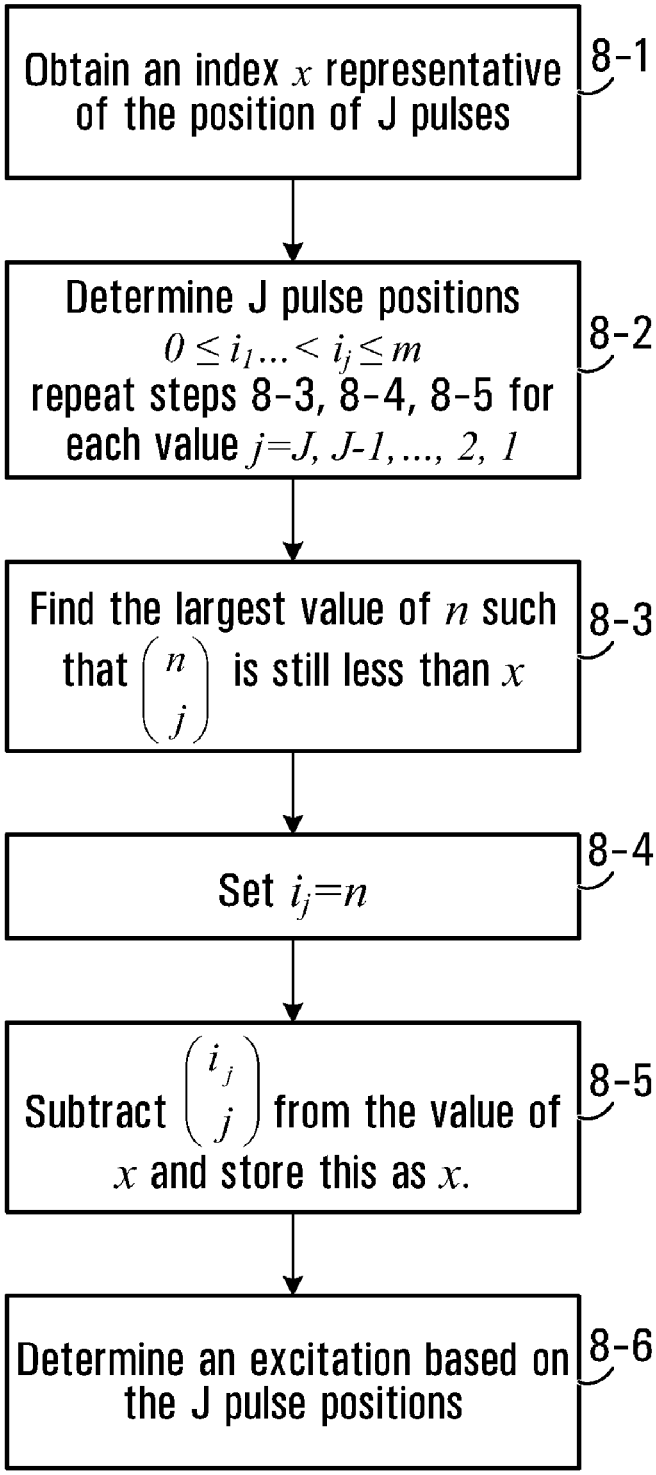
FIG. 8 is a flowchart of a first method of source decoding.

Referring now to FIG. 8, shown is a flowchart of one decoding method based on the second decoding example. The method begins with obtaining an index x representative of the position of J pulses in block 8-1. The method continues in block 8-2 with determining J pulse positions $0 \leqq i_1 \ldots < i_J \leqq m$, and repeating a), b) and c) for each value j=J, J−1, . . . , 2, 1:

a) find the largest value of n such that $$\binom{n}{j}$$

is still less than x (block 8-3);

b) Set $i_1$=n (8-4);

c) Subtract $$\binom{i_j}{j}$$

from the value of x and store this as x, where the order of steps b) and c) can be reversed (block 8-5). The method continues in block 8-6 with determining an excitation based on the J pulse positions. As indicated previously, this may involve determining a component based on the pulse positions, and combining this with one or more other components to produce the excitation.

Arithmetic Source Coding Example

In addition to the coding method described above, the following is an equivalent coding method based on arithmetic coding. This approach is described for J pulse positions out of a possible m. For the particular AMR-WB application, J is set to 6, and m is set to 16.

Figure 9:
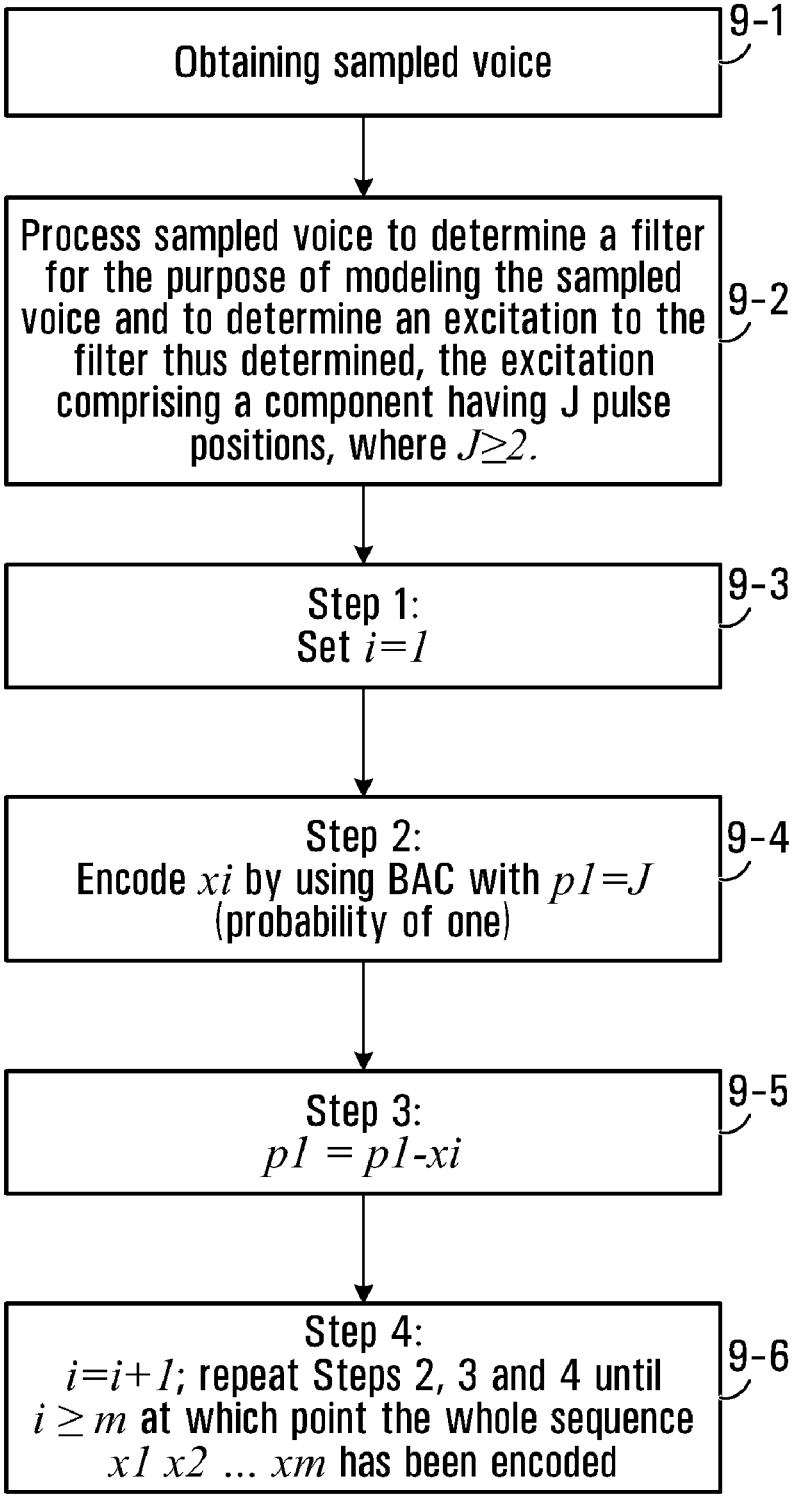
FIG. 9 is a flowchart of a second method of source encoding.

Referring now to FIG. 9, shown is a flowchart of an arithmetic source encoding method. The method begins at block 9-1 with obtaining sampled voice. In block 9-2, the sampled voice is processed to determine a filter for the purpose of modeling the sampled voice and to determine an excitation to the filter thus determined, the excitation comprising a component having J pulse positions, where J≧2. There are J (for example J=6) pulse positions to be selected from m (for example m=16) possible positions. Let x1 x2 . . . xm be a binary sequence, where xi=1 indicates a pulse position and xi=0 indicates otherwise. Then the binary sequence x1 x2 . . . xm is encoded by using binary arithmetic coding (BAC) as follows:

Step 1: Set i=1 (block 9-3)

Step 2: Encode xi by using BAC with p1=J (probability of one) (block 9-4)—see brief description below;

Step 3: p1=p1−xi (block 9-5);

Step 4: i=i+1; repeat Steps 2, 3 and 4 until i≧m at which point the whole sequence x1 x2 . . . xm has been encoded (block 9-6).

Figure 10:
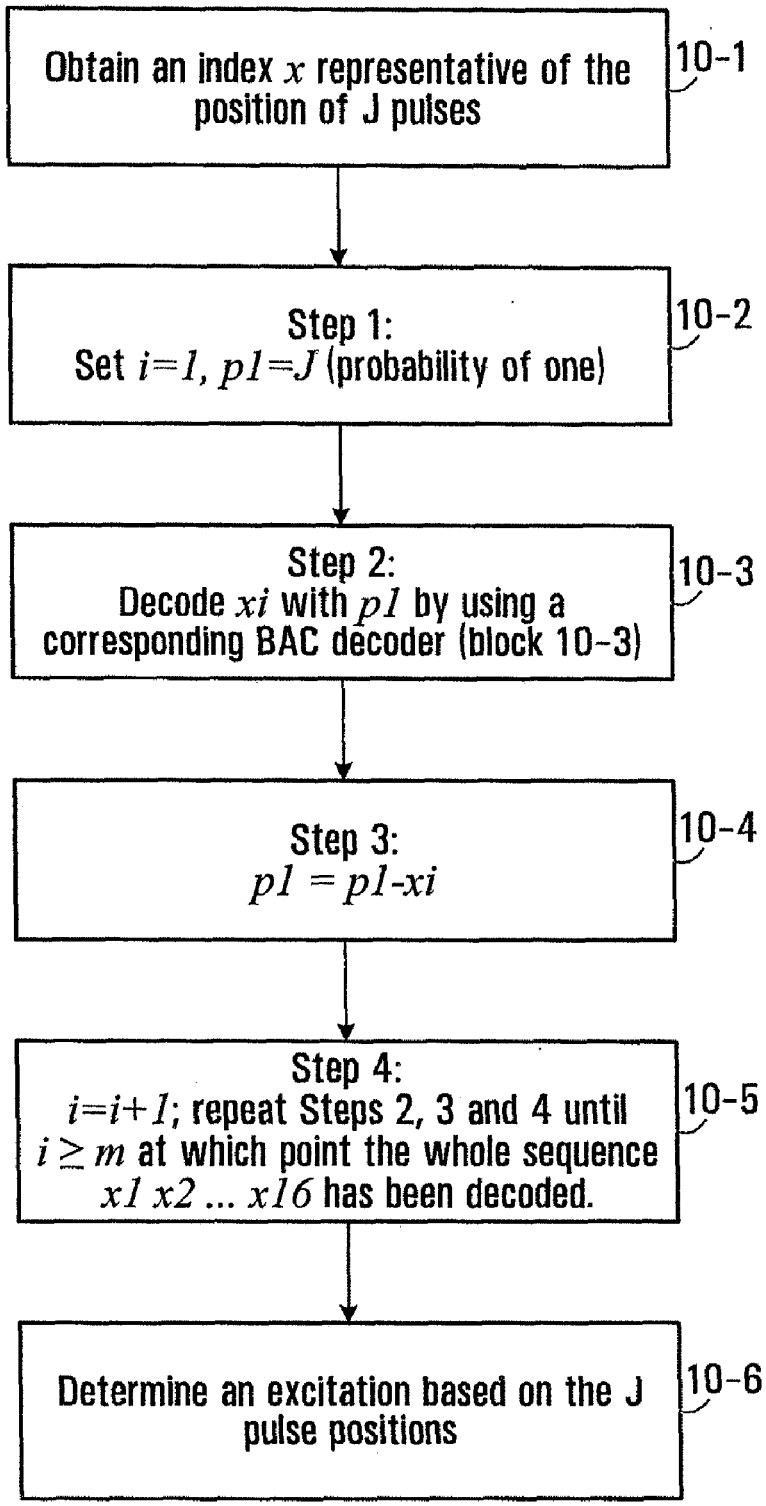
FIG. 10 is a flowchart of a second method of source decoding.

Referring now to FIG. 10, shown is a flowchart of a corresponding decoding method. The method begins with obtaining an index x representative of the position of J pulses in block 10-1. The method continues with:

Step 1: Set i=1, p1=J (probability of one) (block 10-2);

Step 2: Decode xi with p1 by using a corresponding BAC decoder (block 10-3)—see brief description below;

Step 3: p1=p1−xi (block 10-4);

Step 4: i=i+1; repeat Steps 2, 3 and 4 until i≧m at which point the whole sequence x1 x2 . . . x16 has been decoded (block 10-5).

Finally, and excitation based on the J pulse postitions is determined (block 10-6).

In the description of the encoding and decoding operations above, p1 specifies the probability of one. It is set to J because it is known there are J 1's in x1 x2 . . . x16. Once xi is encoded or decoded, p1 is adjusted accordingly: if xi=1, p1 is reduced by one as there are one less 1's in the remaining sequence to be encoded; otherwise p1 remains unchanged.

Various BAC encoding and decoding schemes may be employed. These are well known to persons skilled in the art. The following is a specific example.

When encoding a symbol xi with p1, a BAC encoder works as follows. Let [l, h) be an interval between [0, 1) on the real line resulting from encoding the previous symbol. The BAC encoder partitions [l, h) into two intervals: [l, l+r*p1), [l+r*p1, h), where r=h−l. In the case of xi=1, the middle point of the former interval of length r*p1 is sent to the decoder by using −log 2 (p1) bits. In the case of xi=0, the middle point of the latter interval of length r*(1−p1) is sent to the decoder by using −log 2 (1−p1) bits.

On the decoder side, the corresponding BAC decoder works as follows to decode xi with p1 from the previous interval [l, h): After reading enough bits from the encoder, the decoder can locate whether xi lies in [l, l+r*p1) or [l+r*p1, h), and correspondingly set xi=1 or xi=0, respectively.

It can be verified that the compression rate of the above method is equal to the method based on enumerative coding described above. Note that this arithmetic coding-based method is sequential and thus might be preferred in some applications.

Comparison of Provided Source Coding with Existing AMR-WB Coding

The effect of applying the one of four provided encoding approaches to the existing AMR-WB coding rates will now be described.

The 23.05 kbps and 23.85 kbps modes both use 6 pulses for each of 4 tracks. Applying the provided encoding approach, the second example above can be used with J=6, and m=16 for each of the four tracks. The total number of different indexes is $$\binom{m}{J} = \binom{16}{6} = 8008.$$

Since $2^{13}$=8192>8008, an index can be encoded using 13 bits. Also the 6 pulse signs can be encoded with 6 bits. Therefore, using the provided approach, the locations and signs of the pulses can be encoded with a total of 19 bits. In comparison, the pulses are encoded with 22 bits in the AMR-WB specification.

Since there are 4 tracks per subframe and 4 subframes per frame, this modification in the encoding of the pulses saves a total of 3×4×4=48 bits per 20 msec frame. Since there are 50 frames per second, a total of 50×48=2400 bits per second are saved with the top two rates of AMR-WB.

The 19.85 kbps mode uses 5 pulses in 2 of the 4 tracks and 4 pulses in the other 2. For the tracks with 5 pulses, applying the provided encoding approach, the second example above can be used with J=5, and m=16 for each of two tracks. The number of different indexes is $$\binom{m}{J} = \binom{16}{5} = 4368.$$

Since $2^{13}$=8192>4368, an index can be encoded using 13 bits. Also the 5 pulse signs can be encoded with 5 bits. Therefore, using the provided approach, the locations and signs of the pulses can be encoded with a total of 18 bits.

For the tracks with 4 pulses, applying the provided encoding approach, the second example above can be used with J=4, and m=16 for each of two tracks. The number of possible indexes is $$\binom{m}{J} = \binom{16}{4} = 1820.$$

Since $2^{11}$=2048>1820, one index can be encoded using 11 bits. Also the 4 pulse signs can be encoded with 4 bits. Therefore, using the provided approach, the locations and signs of the pulses can be encoded with a total of 15 bits.

Thus, in total, for one subframe the four tracks can be encoded with 18×2+15×2=66 bits. In contrast, the AMR-WB speech codec encodes the algebraic codebook index for one subframe with 72 bits. Since there are 4 subframes per frame and 50 frames per second in AMR-WB, this is a savings of 6×4×50=1200 bits per second for the 19.85 kbps mode.

The 18.25 kbps mode uses 4 pulses in each of the 4 tracks. As mentioned previously, these pulses can be encoded with 15 bits using the provided approach. Therefore the algebraic codebook index for one subframe can be encoded with a total of 4×15=60 bits. In contrast, the AMR-WB speech codec encodes the algebraic codebook index for one subframe with 64 bits. Since there are 4 subframes per frame and 50 frames per second in AMR-WB, this is a savings of 4×4×50=800 bits per second for the 18.25 kbps mode.

In summary, the provided encoding approach reduces the bit rates of the 4 highest rates as follows:

23.85->21.45;
23.05->20.65;
19.85->18.65;
18.25->17.45.

Thus, 2400 bps could be saved off the top two rates, 1200 bps off the $3^{rd}$ highest rate, and 800 bps off the $4^{th}$ highest rate.

In some embodiments, a conversion between two encoding schemes (for example one of the current AMR-WB encoding schemes to or from one of the provided encoding schemes) is performed. The apparatuses of FIGS. 5 and 6 achieve this. This could be done by decoding from one encoding scheme and re-encoding with the other, or by using a lookup table, to name a few examples. In some embodiments, this is performed when switching between a TCP (Transmission Control Protocol) type transfer and a RTP/UDP (Real-time Transport Protocol/User Datagram Protocol) transfer. In some embodiments, a server stores a media file locally for example in one of the provided coding schemes and optionally converts it to the original AMR-WB coding scheme before real time streaming to a client. In some embodiments, the server will convert to the original format, or not, depending on the application.

For example, in some embodiments, when connecting to a server to do HTTP (hypertext transfer protocol) streaming, then the server can return the file in one of the provided coding schemes so as to reduce the bandwidth. If the same server were also an RTSP (Real Time Streaming Protocol) server, then it could stream the file in the original format.

Figure 11:
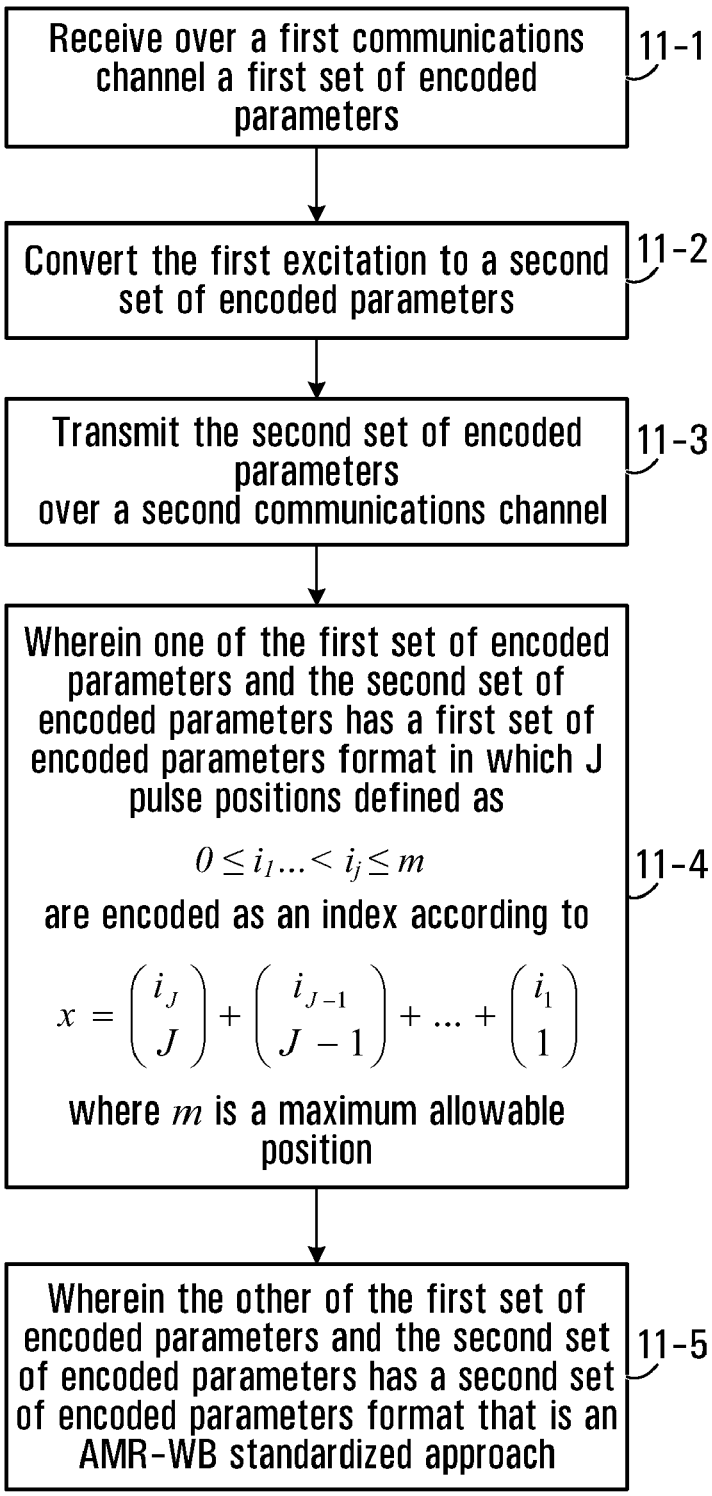
FIG. 11 is a flowchart of a first method of performing conversion between two different source coding schemes.

Referring to FIG. 11, shown is a flowchart of a method of converting between source code schemes. The method begins in block 11-1 with receiving over a first communications channel a first set of encoded parameters representative of a component of an excitation. The method continues with converting the first set of encoded parameters to a second set of encoded parameters excitation (block 11-2), transmitting the second set of encoded parameters over a second communications channel (block 11-3). One of the first set of encoded parameters and the second set of encoded parameters has a first format in which J pulse positions defined as $0 \leqq i_1 \ldots < i_J \leqq m$ are encoded as an index according to $$x = \binom{i_J}{J} + \binom{i_{J-1}}{J-1} + \ldots + \binom{i_1}{1}$$

where $$\binom{n}{k}$$

for n<k is defined to be 0, and where m is a maximum allowable position (block 11-4). The other of the first and the second sets of encoded parameters has a second format that may, for example, be based on an AMR-WB standardized approach (block 11-5).

Figure 12:
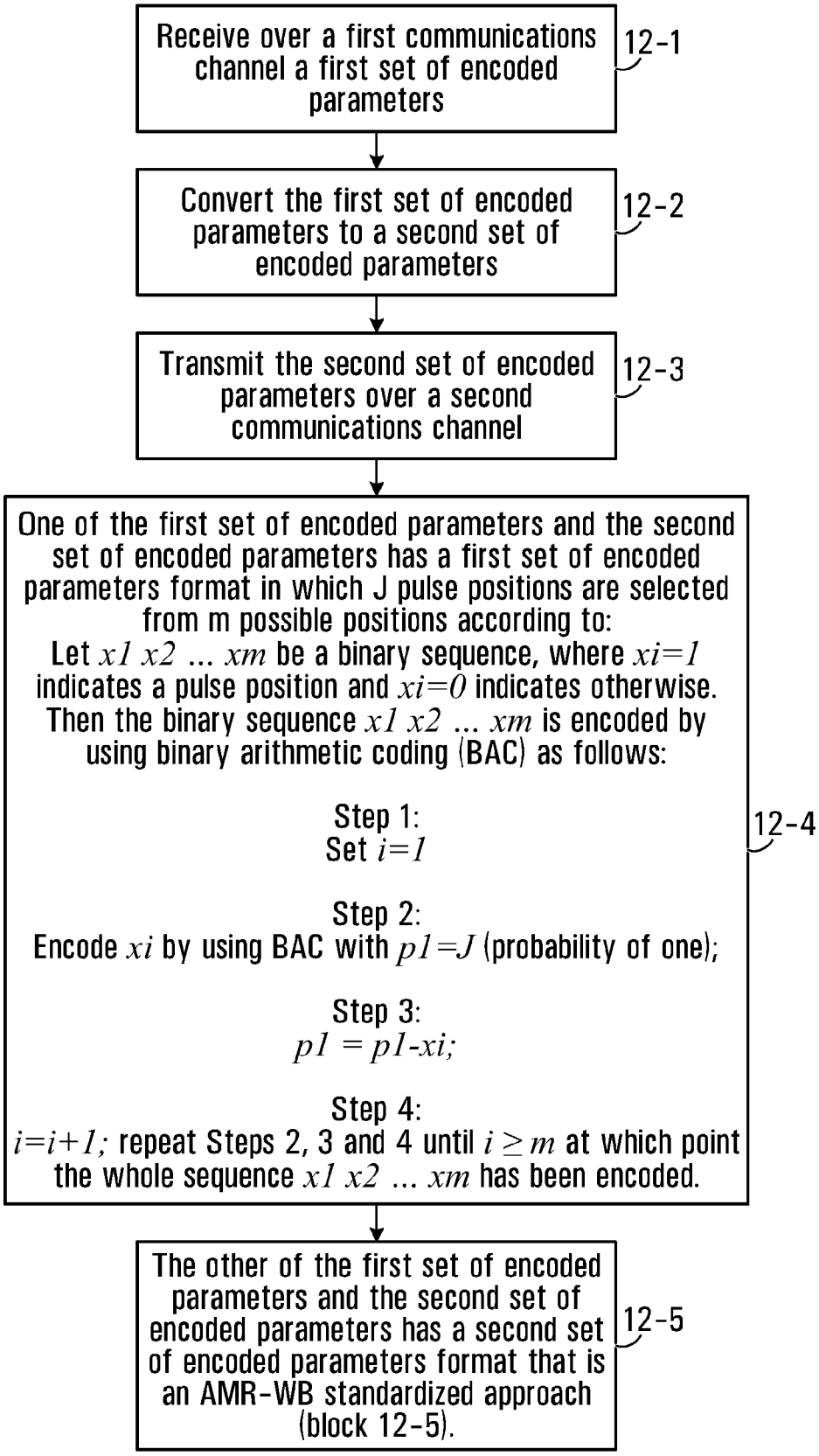
FIG. 12 is a flowchart of a second method of performing conversion between two different source coding schemes.

Referring to FIG. 12, shown is a flowchart of a method of converting between source code schemes. The method begins in block 12-1 with receiving over a first communications channel a first set of encoded parameters representative of a component of an excitation. The method continues with converting the first set of encoded parameters to a second set of encoded parameters (block 12-2), transmitting the second set of encoded parameters over a second communications channel (block 12-3). One of the first and second sets of encoded parameters has a first format in which J (for example J=6) pulse positions are selected from m (for example m=16) possible positions according to:

Let x1 x2 . . . xm be a binary sequence, where xi=1 indicates a pulse position and xi=0 indicates otherwise. Then the binary sequence x1 x2 . . . xm is encoded by using binary arithmetic coding (BAC) as follows:

Step 1: Set i=1

Step 2: Encode xi by using BAC with p1=J (probability of one);

Step 3: p1=p1−xi;

Step 4: i=i+1; repeat Steps 2, 3 and 4 until i≧m at which point the whole sequence x1 x2 . . . xm has been encoded.

The other of the first and second sets of encoded parameters has a second format that may, for example, be based on an AMR-WB standardized approach (block 12-5).

In some embodiments, wireless devices are provided that use one of the provided coding schemes to reduce bandwidth over the network.

Embodiments also provide a codec containing device, such as a mobile device, that is configured to implement any one or more of the methods described herein.

Further embodiments provide computer readable media having computer executable instructions stored thereon, that when executed by a processing device, execute any one or more of the methods described herein.

Figure 13:
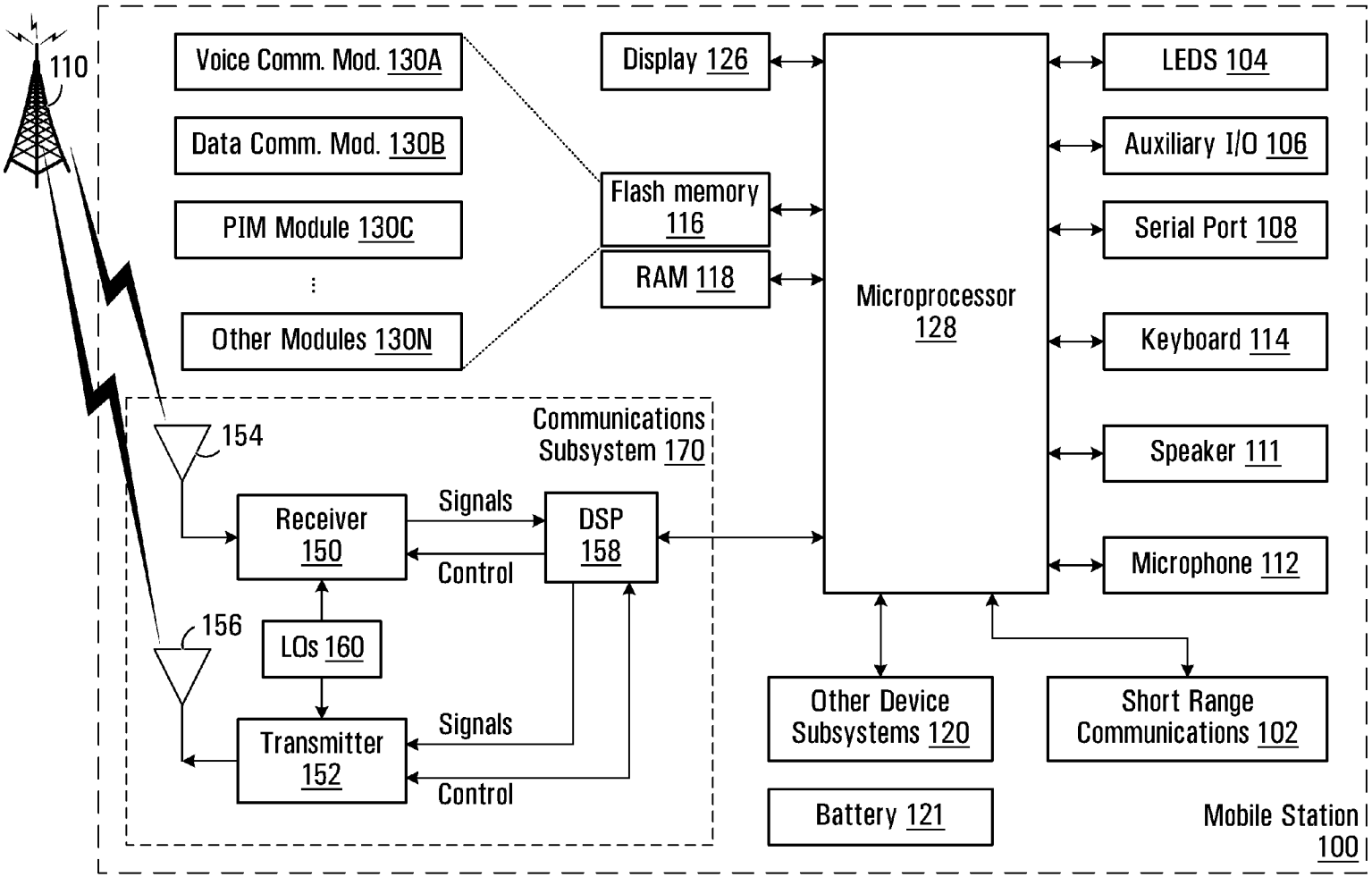
FIG. 13 is block diagram of another mobile device.

Referring now to FIG. 13, shown is a block diagram of another wireless device 100 that may implement any of the device methods described in this disclosure. The wireless device 100 is shown with specific components for implementing features similar to those of the mobile device 30 of FIG. 3 or the mobile device 31 of FIG. 4. It is to be understood that the wireless device 100 is shown with very specific details for exemplary purposes only.

A processing device (a microprocessor 128) is shown schematically as coupled between a keyboard 114 and a display 126. The microprocessor 128 controls operation of the display 126, as well as overall operation of the wireless device 100, in response to actuation of keys on the keyboard 114 by a user.

The wireless device 100 has a housing that may be elongated vertically, or may take on other sizes and shapes (including clamshell housing structures). The keyboard 114 may include a mode selection key, or other hardware or software for switching between text entry and telephony entry.

In addition to the microprocessor 128, other parts of the wireless device 100 are shown schematically. These include: a communications subsystem 170; a short-range communications subsystem 102; the keyboard 114 and the display 126, along with other input/output devices including a set of LEDs 104, a set of auxiliary I/O devices 106, a serial port 108, a speaker 111 and a microphone 112; as well as memory devices including a flash memory 116 and a Random Access Memory (RAM) 118; and various other device subsystems 120. The wireless device 100 may have a battery 121 to power the active elements of the wireless device 100. The wireless device 100 is in some embodiments a two-way radio frequency (RF) communication device having voice and data communication capabilities. In addition, the wireless device 100 in some embodiments has the capability to communicate with other computer systems via the Internet.

Operating system software executed by the microprocessor 128 is in some embodiments stored in a persistent store, such as the flash memory 116, but may be stored in other types of memory devices, such as a read only memory (ROM) or similar storage element. In addition, system software, specific device applications, or parts thereof, may be temporarily loaded into a volatile store, such as the RAM 118. Communication signals received by the wireless device 100 may also be stored to the RAM 118.

The microprocessor 128, in addition to its operating system functions, enables execution of software applications on the wireless device 100. A predetermined set of software applications that control basic device operations, such as a voice communications module 130A and a data communications module 130B, may be installed on the wireless device 100 during manufacture. In addition, a personal information manager (PIM) application module 130C may also be installed on the wireless device 100 during manufacture. The PIM application is in some embodiments capable of organizing and managing data items, such as e-mail, calendar events, voice mails, appointments, and task items. The PIM application is also in some embodiments capable of sending and receiving data items via a wireless network 110. In some embodiments, the data items managed by the PIM application are seamlessly integrated, synchronized and updated via the wireless network 110 with the device user's corresponding data items stored or associated with a host computer system. As well, additional software modules, illustrated as another software module 130N, may be installed during manufacture.

Communication functions, including data and voice communications, are performed through the communication subsystem 170, and possibly through the short-range communications subsystem 102. The communication subsystem 170 includes a receiver 150, a transmitter 152 and one or more antennas, illustrated as a receive antenna 154 and a transmit antenna 156. In addition, the communication subsystem 170 also includes a processing module, such as a digital signal processor (DSP) 158, and local oscillators (LOs) 160. The specific design and implementation of the communication subsystem 170 is dependent upon the communication network in which the wireless device 100 is intended to operate. For example, the communication subsystem 170 of the wireless device 100 may be designed to operate with the Mobitex™, DataTAC™ or General Packet Radio Service (GPRS) mobile data communication networks and also designed to operate with any of a variety of voice communication networks, such as Advanced Mobile Phone Service (AMPS), Time Division Multiple Access (TDMA), Code Division Multiple Access (CDMA), Personal Communications Service (PCS), Global System for Mobile Communications (GSM), etc. Examples of CDMA include 1X and 1x EV-DO.

The communication subsystem 170 may also be designed to operate with an 802.11 Wi-Fi network, and/or an 802.16 WiMAX network. Other types of data and voice networks, both separate and integrated, may also be utilized with the wireless device 100.

Network access may vary depending upon the type of communication system. For example, in the Mobitex™ and DataTAC™ networks, wireless devices are registered on the network using a unique Personal Identification Number (PIN) associated with each device. In GPRS networks, however, network access is typically associated with a subscriber or user of a device. A GPRS device therefore typically has a subscriber identity module, commonly referred to as a Subscriber Identity Module (SIM) card, in order to operate on a GPRS network.

When network registration or activation procedures have been completed, the wireless device 100 may send and receive communication signals over the communication network 110. Signals received from the communication network 110 by the receive antenna 154 are routed to the receiver 150, which provides for signal amplification, frequency down conversion, filtering, channel selection, etc., and may also provide analog to digital conversion. Analog-to-digital conversion of the received signal allows the DSP 158 to perform more complex communication functions, such as demodulation and decoding. In a similar manner, signals to be transmitted to the network 110 are processed (e.g., modulated and encoded) by the DSP 158 and are then provided to the transmitter 152 for digital to analog conversion, frequency up conversion, filtering, amplification and transmission to the communication network 110 (or networks) via the transmit antenna 156.

In addition to processing communication signals, the DSP 158 provides for control of the receiver 150 and the transmitter 152. For example, gains applied to communication signals in the receiver 150 and the transmitter 152 may be adaptively controlled through automatic gain control algorithms implemented in the DSP 158.

In a data communication mode, a received signal, such as a text message or web page download, is processed by the communication subsystem 170 and is input to the microprocessor 128. The received signal is then further processed by the microprocessor 128 for an output to the display 126, or alternatively to some other auxiliary I/O devices 106. A device user may also compose data items, such as e-mail messages, using the keyboard 114 and/or some other auxiliary I/O device 106, such as a touchpad, a rocker switch, a thumb-wheel, or some other type of input device. The composed data items may then be transmitted over the communication network 110 via the communication subsystem 170.

In a voice communication mode, overall operation of the device is substantially similar to the data communication mode, except that received signals are output to a speaker 111, and signals for transmission are generated by a microphone 112. Alternative voice or audio I/O subsystems, such as a voice message recording subsystem, may also be implemented on the wireless device 100. In addition, the display 126 may also be utilized in voice communication mode, for example, to display the identity of a calling party, the duration of a voice call, or other voice call related information.

The short-range communications subsystem 102 enables communication between the wireless device 100 and other proximate systems or devices, which need not necessarily be similar devices. For example, the short range communications subsystem may include an infrared device and associated circuits and components, or a Bluetooth™ communication module to provide for communication with similarly-enabled systems and devices.

In FIG. 13, a codec (not shown) is provided to implement any one of the source coding methods and/or source decoding methods described above. This may, for example, be provided as part of the voice communications module 130A, or the DSP 158 if the DSP includes coding and decoding speech signals.

Those skilled in the art will recognize that a mobile UE device may sometimes be treated as a combination of a separate ME (mobile equipment) device and an associated removable memory module. Accordingly, for purpose of the present disclosure, the terms "mobile device" and "communications device" are each treated as representative of both ME devices alone as well as the combinations of ME devices with removable memory modules as applicable.

Also, note that a communication device might be capable of operating in multiple modes such that it can engage in both CS (Circuit-Switched) as well as PS (Packet-Switched) communications, and can transit from one mode of communications to another mode of communications without loss of continuity. Other implementations are possible.

Numerous modifications and variations of the present disclosure are possible in light of the above teachings. It is therefore to be understood that within the scope of the appended claims, the disclosure may be practiced otherwise than as specifically described herein.

The invention claimed is:

1. A method comprising:

obtaining sampled voice;

processing the sampled voice to determine a filter for the purpose of modeling the sampled voice and to determine an excitation to the filter, a component of the excitation comprising J pulse positions, where $J \geqq 2$, to be selected from m (for example m=16) possible positions, the component of the excitation represented by a binary sequence x1, x2, . . . , xm, where xi=1 indicates a pulse position and xi=0 indicates otherwise;

encoding the component of the excitation by:

Step 1: Setting i=1;

Step 2: Encoding xi by using BAC (Binary Arithmetic Coding) with p1=J (probability of one);

Step 3: p1=p1−xi;

Step 4: i=i+1; repeating Steps 2, 3 and 4 until $i \geqq m$ at which point the whole sequence x1, x2, . . . , xm has been encoded.

2. The method of claim 1 wherein obtaining sampled voice comprises:

receiving a voice input signal; and sampling the voice input signal to produce the sampled voice.

3. The method of claim 1 wherein the component of the excitation comprises four tracks with J=6 pulses each having a pulse position that is one of 16 possible positions per track, the method comprising:

performing said encoding J pulse positions for each of the four tracks with J=6, wherein the position information for each track is encoded with 13 bits and the signs are encoded with 6 bits for a total of 19 bits per track.

4. The method of claim 1 wherein the component of the excitation comprises two tracks with J=6 pulses each having a pulse position that is one of 16 possible positions per track, and two tracks with J=5 pulses each having a pulse position that is one of 16 possible positions per track, the method comprising:

performing said encoding J pulse positions for each of two tracks with J=6, wherein the position information for each track with J=6 is encoded with 13 bits and the signs are encoded with 6 bits for a total of 19 bits per track;

performing said encoding J pulse positions for each of two tracks with J=5, wherein the position information for each track with J=5 is encoded with 13 bits and the signs are encoded with 5 bits for a total of 18 bits per track.

5. The method of claim 1 wherein the component of the excitation comprises two tracks with J=5 pulses each having a pulse position that is one of 16 possible positions per track, and two tracks with J=4 pulses each having a pulse position that is one of 16 possible positions per track, the method comprising:

performing said encoding J pulse positions for each of two tracks with J=5, wherein the position information for each track with J=5 is encoded with 13 bits and the signs are encoded with 5 bits for a total of 18 bits per track;

performing said encoding J pulse positions for each of two tracks with J=4, wherein the position information for each track with J=4 is encoded with 11 bits and the signs are encoded with 4 bits for a total of 15 bits per track.

6. The method of claim 1 wherein the component of the excitation comprises four tracks with J=4 pulses each having a pulse position that is one of 16 possible positions per track, the method comprising:

performing said encoding J pulse positions for each of four tracks with J=4, wherein the position information for each track with J=4 is encoded with 11 bits and the signs are encoded with 4 bits for a total of 15 bits per track.

7. The method of claim 1 wherein the component of the excitation comprises a fixed codebook portion for an algebraic code.

8. A method comprising:

obtaining an index x representative of the position of J pulses;

Step 1: Setting i=1, p1=J (probability of one);

Step 2: Decoding xi with p1 by using a corresponding BAC decoder;

Step 3: p1=p1−xi;

Step 4: i=i+1; repeating Steps 2, 3 and 4 until i>m at which point the whole sequence x1, x2, . . . , x16 has been decoded; and determining a component of an excitation based on the J pulse positions.

9. The method of claim 8 further comprising:

combining the pulse positions thus determined with sign information to produce the component of the excitation;

receiving a set of filter coefficients associated with the index x;

driving a filter having the set of filter coefficients associated with the index x with the excitation to produce voice samples.

10. The method of claim 8 further comprising:

re-encoding the pulse positions using a different method to produce a re-encoded index y;

at least one of:

a) transmitting the re-encoded index y;

b) storing the re-encoded index y.

11. The method of claim 8 further comprising:

combining the pulse positions with sign information to produce the component of the excitation, and then driving a filter with the excitation to produce voice samples.

12. The method of claim 8 wherein the excitation comprises four tracks with J=6 pulses each having a pulse position that is one of 16 possible positions per track, the method comprising:

performing said determining J pulse positions for each of the four tracks with J=6, wherein the position information for each track is encoded with 13 bits and the signs are encoded with 6 bits for a total of 19 bits per track.

* * * * *